US005957198A

United States Patent [19]

Haynes

[11] Patent Number: 5,957,198

[45] Date of Patent: Sep. 28, 1999

[54] TELESCOPING JOINT FOR USE IN CONDUIT CONNECTED WELLHEAD AND ZONE ISOLATING TOOL

[76] Inventor: Michael Jonathon Haynes, Box 12, Site #7, RR3, Alberta, Canada, T46 1T8

[21] Appl. No.: 08/946,510

[22] Filed: Oct. 7, 1997

[51] Int. Cl.[6] ..... E21B 47/00

[52] U.S. Cl. ..... 166/250.03; 166/333.1; 166/334.1; 166/387

[58] Field of Search ..... 166/250.03, 381, 166/387, 334.1, 333.1

[56] References Cited

U.S. PATENT DOCUMENTS

| | | | |
|---|---|---|---|
| 3,646,995 | 3/1972 | Manes et al. | 166/336 |
| 3,791,449 | 2/1974 | Cochran | 166/381 X |
| 3,830,306 | 8/1974 | Brown | 166/334.2 X |
| 4,386,656 | 6/1983 | Fisher et al. | 166/212 X |
| 4,403,654 | 9/1983 | Haynes . | |
| 4,546,830 | 10/1985 | McLaughlin et al. . | |
| 4,805,696 | 2/1989 | Henderson | 166/237 X |
| 4,942,925 | 7/1990 | Themig | 166/237 X |
| 5,049,037 | 9/1991 | Carson et al. . | |
| 5,443,120 | 8/1995 | Howell . | |
| 5,465,788 | 11/1995 | Wright . | |
| 5,579,838 | 12/1996 | Michael . | |

*Primary Examiner*—Roger Schoeppel
*Attorney, Agent, or Firm*—Dority & Manning, P.A.

[57] ABSTRACT

A telescoping joint for use in a conduit connected to a wellhead and supporting downhole well tools to permit the downhole well tools to be axially displaced in the well bore without disconnecting the conduit from the wellhead is described. The telescoping joint is particularly useful in conjunction with an apparatus for providing an axially displaceable isolated fluid zone in a cased well bore, which is also described. The telescoping joint and the apparatus are used in conjunction for producing a predominance of a fluid of interest from a cased well bore which passes through a production zone that yields at least two fluids having different densities. The telescoping joint may also be used in conjunction with other downhole tools for performing a plurality of downhole operations which require axial displacement of the tools in the well bore without disconnection of the conduit from the wellhead. The advantage is the ability to move downhole well tools supported by a conduit such as a production tubing up or down in the well bore without disconnecting the production tubing from the wellhead or removing or adding sections to the tubing string. This permits many downhole operations to be much more economically and quickly accomplished including the selective production of oil or gas from water-bearing formations.

25 Claims, 5 Drawing Sheets

TELESCOPING JOINT FOR USE IN CONDUIT CONNECTED WELLHEAD AND ZONE ISOLATING TOOL

TECHNICAL FIELD

The present invention relates to the handling of downhole well tools, and in particular to a telescoping joint for use in a conduit connected to a wellhead and supporting downhole well tools to permit the downhole well tools to be axially displaced in the well bore without disconnecting the conduit from the wellhead, as well as to a downhole well tool for creating an isolated fluid zone in a cased well bore.

BACKGROUND OF THE INVENTION

Downhole operations and the handling of downhole well tools in completed wells has always presented a certain challenge, especially when working in wells having a natural pressure that exceeds atmospheric pressure necessitating the containment of the well at all times. Another challenge has been the maintenance of well bores which pass through production zones that are not well suited to continuous production. For example, production zones which yield both water and oil may require frequent repositioning of production tubing in order to recover oil efficiently. Another example is production zones which produce crude oil high in waxy compounds or asphaltines or laden with salts which tend to plug casing perforations and therefore require frequent treatment to maintain an economic flow of hydrocarbon. To date, the maintenance of such wells has proven time-consuming and expensive. For example, in wells which produce both oil and water and have a mobile water/oil interface, the production of oil gradually decreases over time until only water is produced from the well. Relocation of the bottom end of the production tubing string is then required to recommence oil production. The relocation of the tubing string typically involves at least the following steps:

1) killing the well with kill fluid or running in plugs so the wellhead can be removed;
2) removing the wellhead;
3) installing BOPs;
4) pulling the production tubing;
5) cleaning the casing;
6) running in a cement retainer;
7) cementing off the borehole at the current water/oil interface;
8) perforating the casing above the cement;
9) running back the production tubing;
10) replacing the wellhead; and
11) removing the drilling mud to restore production.

It is not difficult to appreciate that there is a need for a more efficient and less costly system for producing oil from such wells.

Methods have been invented for producing hydrocarbons from water-bearing formations. One such method is described in U.S. Pat. No. 5,443,120 which issued on Aug. 22nd, 1995 to Howell. This patent describes a method for improving the productivity of a well by separating and disposing of at least a portion of the water which is produced from a subterranean producing formation. The water is permitted to separate from the produced fluids under the influence of gravity while in the well bore. The separated water is disposed of without removing it from the well bore by flowing it into a subterranean disposal formation which has a pressure less than that of the producing formation. In order to accomplish this, the well is completed with an inclined well bore which aids in the gravity separation of the water from the produced hydrocarbons. A problem with this method is that it requires a low pressure disposal formation located beneath the producing formation. Besides, the inclined well bore is problematic unless there is adequate natural pressure to produce oil to the surface since the inclination of the well bore makes connecting pumping equipment or the like inconvenient.

Another challenge in the industry is the "barefoot" completion of wells. Barefoot completions are desirable if losing drilling mud into a production zone is likely to damage the zone or the zone contains toxic gases such as sour gas. Drilling contractors frequently do not complete such wells. Rather, they drill down and case the well to an area just above the production zone and leave the bore to be completed after a casing flange and blowout preventers are installed. A completion rig is brought in and the last few meters into the production zone are drilled. The bottom of the bore is usually not cased, hence the name "barefoot". If barefoot completion is effected in a "critical zone" known or suspected to contain toxic gas, regulations normally require many precautionary measures. For example, gas ignition equipment must be on standby, manned, downwind monitors must be on site and at least one safety person must be on location until the completion is finished. There therefore exists a need for a simpler, more cost-effective way of completing wells in critical zones.

It is known in the prior art to use a torque-transmitting expansion joint to permit a selectively adjustable extent of axial contraction in production tubing to absorb temperature-produced variations in length of a space-out section or dimensional differences between the planned and actual location of a surface hanger with respect to a downhole tubing hanger. Such apparatus is described in U.S. Pat. No. 4,403,654 which issued on Sep. 13, 1983 to Haynes. This expansion joint is designed to permit limited axial movement of a tubing string in which it is installed while permitting rotational torque to be transmitted through the joint. While this expansion joint is useful in its intended application, it does not contribute to a solution to the problems of selective production or well bore completions described above. Nor does it contribute a solution for the relocation of downhole tools without the disconnection of a tubing string from the wellhead.

It is therefore desirable to provide an apparatus for use in a conduit in a well bore such as a tubing string for supporting downhole well tools to permit the downhole well tools to be axially displaced in the well bore without disconnecting the conduit from the wellhead.

SUMMARY OF THE INVENTION

It is an object of the invention to provide a telescoping joint for use in a conduit connected to a wellhead and supporting downhole well tools to permit the downhole well tools to be axially displaced in the well bore without disconnecting the conduit from the wellhead.

It is a further object of the invention to provide an apparatus for creating an axially displaceable isolated fluid zone in a cased well bore and enabling fluid communication with the isolated fluid zone.

It is yet a further object of the invention to provide a method of using the apparatus in accordance with the invention to produce a predominance of a fluid of interest from a cased well bore which passes through a production zone that yields at least two fluids having different densities.

It is another object of the invention to provide an apparatus which permits barefoot completion of cased well bores on which a wellhead is installed.

It is yet a further object of the invention to provide an apparatus which facilitates production zone logging in a cased, completed well by enabling the retraction of production tubing from the production zone to permit logging without interference from the tubing.

It is yet a further object of the invention to provide an apparatus which permits selective testing of a production zone to enable optimal production from the zone.

It is yet a further object of the invention to provide an apparatus which permits selective stimulation of a production zone to ensure that the entire zone, or selected regions of the zone, are most effectively stimulated.

The objects of the invention are enabled by a telescoping joint for use in a conduit connected to a wellhead and supporting downhole well tools to permit the downhole well tools to be axially displaced in the well bore without disconnecting the conduit from the wellhead, comprising:

first and second telescopingly interconnected tubular sections having opposite ends adapted for connection to the conduit; and a latch point for connection of a member for extending or retracting the telescoping joint, the latch point being disposed internally of the telescoping joint so that the member can be inserted through the telescoping joint and connected to the latch point to controllably extend or retract the telescoping joint from one end of the conduit.

The objects of the invention are further enabled by an apparatus for providing an axially displaceable isolated fluid zone in a cased well bore and enabling fluid communication therewith, comprising in combination:

a tubing string having a top end and a bottom end;

at least one pair of sealing means for engaging an inner periphery of the casing of the cased well bore in a fluid tight seal, the sealing means being attached to the tubing string in a spaced-apart relationship for providing at least one isolated fluid zone when the tubing string is inserted in the cased well bore and the sealing means are in sealing engagement with the casing;

means for enabling fluid communication between the at least one isolated fluid zone in the well bore and an interior of the tubing string;

a telescoping joint for permitting axial displacement of a bottom section of the tubing string with respect to a top section thereof, the telescoping joint being located above the at least one pair of sealing means; and means for permitting the bottom section of the tubing string to be displaced with respect to the top section, whereby when the tubing string is inserted in a well bore and the top section of the tubing string is attached to a tubing hanger or directly to the wellhead, the bottom section of the tubing string may be axially displaced to reposition the isolated fluid zone in the cased well bore.

The apparatus in accordance with the invention also enables a method for producing a predominance of a fluid of interest from a cased well bore which passes through a production zone that yields at least two fluids having different densities, comprising:

a) locating a position of the production zone, a position of interfaces between the at least two fluids and a distance between top and bottom surfaces of the fluid of interest;

b) assembling a tubing string in the cased well bore, the tubing string including:

i) a pair of axially spaced-apart sealing means for providing an isolated fluid zone when the tubing string is inserted in the cased well bore, the sealing means being spaced-apart about as far as the distance between top and bottom surfaces of the fluid of interest, and the pair of sealing means being located on the tubing string so that they are respectively positioned near the top and bottom surfaces when the tubing string is attached to a wellhead of the cased well bore;

ii) means for providing fluid communication between the isolated fluid zone and an interior of the tubing string; and iii) a telescoping joint located above the pair of sealing means to permit axial displacement of a bottom section of the tubing string over a distance about as great as a perforated area of the casing of the cased well bore at the production zone;

c) attaching a top end of the tubing string to a tubing hanger or a wellhead at a top of the casing;

d) positioning the pair of spaced-apart sealing means so that they are respectively located approximate the top and bottom surfaces of the fluid of interest by axially displacing the bottom section of the tubing string using the telescoping joint, if required;

e) producing the fluid of interest from the isolated fluid zone in the well bore through the tubing string; and e) periodically adjusting a position of the bottom section of the tubing string to maintain at least one of the sealing means at the interface between the at least two fluids so that predominantly only the fluid of interest communicates with the isolated fluid zone.

The telescoping joint in accordance with the invention therefore permits the axial displacement of downhole tools supported by a conduit such as a production tubing string without removal of the wellhead or disconnection of the conduit from the wellhead. This enables many innovative simplifications of prior art well completion, maintenance and production procedures. The apparatus for creating an isolated fluid zone in a cased well bore further augments the utility of the telescoping joint and enables further innovative downhole procedures.

For example, the telescoping joint in accordance with the invention permits the barefoot completion of wells. In this procedure, a tubing string is run into a cased well bore which has been completed to within a short distance of a production zone. The tubing string is equipped with a drill bit on its bottom end and a telescoping joint on its top end. As the drill bit completes the well bore, the telescoping joint telescopes downwardly until the bore is completed. The bit can then be dropped in the bore and production begun.

As a further example, a production tubing string is typically extended to near a bottom of the casing perforations in a production zone for the purpose of production. The tubing string, however, interferes with logging the production zone. If the tubing string is equipped with a telescoping joint in accordance with the invention, the tubing string can be pulled up above the production zone to permit accurate logging of the zone.

The telescoping joint in combination with the apparatus for creating an isolated fluid zone also enables many new procedures such as the selective production of a fluid of interest, as described above. It also permits a systematic production testing of a perforated zone to determine which areas of the zone produce best and which, if any, require stimulation or isolation, for example. The combination also permits systematic or selective stimulation of a perforated zone in a cased well bore to optimize production from the bore. The number of applications for both the telescoping joint and the apparatus for creating an isolated fluid zone in a cased well bore are considerable in scope and these tools both alone and in combination can be used to reduce the cost of well completion and the time to production as well as the cost of well maintenance and production of hydrocarbons.

BRIEF DESCRIPTION OF THE DRAWINGS

The invention will now be explained by way of example only and with reference to the following drawings in which.

DETAILED DESCRIPTION OF THE PREFERRED EMBODIMENT

The invention provides apparatus and methods of using the apparatus for performing several downhole operations in well bores which require the axial displacement of downhole tools in wells which are preferably or necessarily contained by a wellhead.

Figure 1:
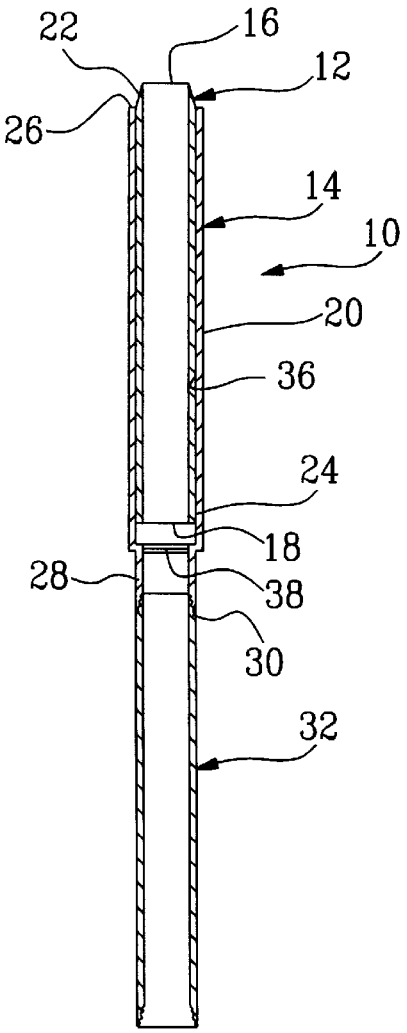
FIG. 1 is a cross-sectional view of a telescoping joint for use in a conduit connected to a wellhead in accordance with the invention.

FIG. 1 shows a cross-sectional view of a novel telescoping joint in accordance with the invention for use in a conduit such as a production tubing connected to a wellhead in supporting downhole well tools to be axially displaced in the well bore without disconnecting the conduit from the wellhead. The telescoping joint, generally indicated by reference 10, includes a first tubular section 12 and a second tubular section 14 which has a larger diameter than the first tubular section. The first tubular section 12 has a first end 16 and a second end 18 and a polished outer surface 20 which extends between the first end 16 and the second end 18. The first end 16 is machined with a standard thread 22 which is compatible with standard tubing connectors. The second end 18 of the first tubular section 12 is provided with a radially projecting stop 24 which serves to prevent the first tubular section 12 from being completely withdrawn from the second tubular section 14 within which it reciprocates. The second tubular section 14 includes a first end 26 and a second end 28. The first end 26 includes inwardly extending seals which cooperate with the polished outer surface 20 of the first tubular section 16 to provide a fluid seal between the first and second sections. The fluid seals are preferably high-pressure fluid seals to ensure that high-pressure fluids will not escape the telescoping Joint 10. The second end 28 of the second tubular section 14 is threaded with an internal thread 30 to enable the connection of a production tubing 32. As will be well understood, the first end of the first tubular section 12 may have an internal thread and the second end 28 of the second tubular section 14 may have an external thread. It is preferable, however, that the opposite ends of the telescoping joint have compatible but opposite threads as is standard for any production tubing section.

It is also desirable that the telescoping joint 10 be enabled to transmit torque. This may be accomplished in many ways well known in the art. For example, one or more radially projecting keys may be affixed to the outer surface of the radial stop 24 such as by welding or the like. The keys 34 are received in keyways in an inner wall 36 of the first tubular section 14 in a manner well known in the art. Alternatively, an inner surface 36 of the second tubular section 14 may be polished and fluid seals may be provided on the radial stop 24 fixed to the second end of the first tubular section 12. This would permit keys to be affixed to the first end of the second tubular section and keyways to be formed in the outer surface 20 of the first tubular section 12. The telescoping joint further includes a latch point 38 for the connection of a slick rod (see FIG. 5) which may be used to raise or lower downhole well tools connected to the production tubing string 32. The latch point 38 may be, for example, an internal thread. While the latch point 38 is shown on an inner surface of the second end 28 of the second tubular section 14, it may likewise be provided on the second end 18 of the first tubular section if the telescoping joint 10 is oppositely oriented with respect to the wellhead. The orientation of the telescoping joint 10 is a matter of design choice and is only material with respect to the location of the latch point 38 which should be located on the tubular section of the telescoping joint 10 that is remote from the wellhead in order to practice the methods in accordance with the invention which will be explained below in detail.

Figure 2:
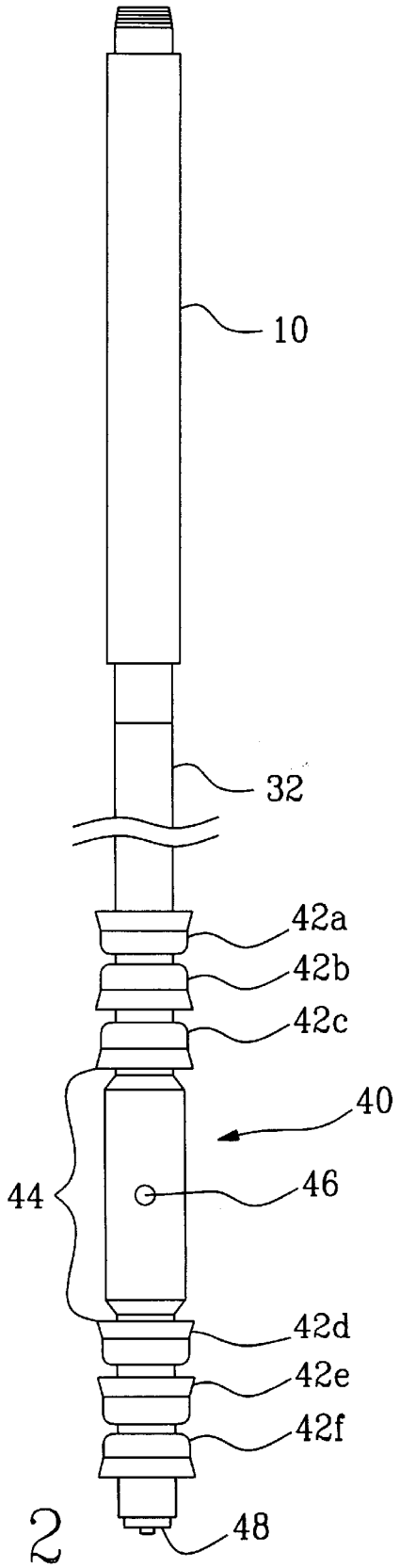
FIG. 2 is an elevational view of a preferred embodiment of a tubing string which includes the telescoping joint shown in FIG. 1 and a zone-isolating tool in accordance with the invention.

FIG. 2 shows an elevational view of a tubing string equipped with apparatus in accordance with the invention. The tubing string 32 includes the telescoping joint 10 located at or near a top of the tubing string and a zone isolating tool generally indicated by the reference 40, located at a bottom of the tubing string 32. In accordance with a preferred embodiment of the invention, the zone isolating tool 40 is assembled using packer cups 42. The packer cups 42 may be, for example, packer cups commercially available from Imperial Rubber of Niksu, Alberta, Canada. The packer cups are assembled in a sequence similar to that of a selective acidizing tool known in the art with the exception that two extra cups are added and an upper cup 42*a* is oriented upwardly and a lower cup 42*f* is oriented downwardly. It should also be understood by those skilled in the art that the two groups of cups 42*a*–42*c* and 42*d*–42*f* may be replaced by straddle packers (not illustrated) or inflatable packers (not illustrated) while still achieving substantially the same utility. Intermediate between the groups of cups 42*a*–42*c* and 42*d*–42*f* is an isolated fluid zone which is isolated by the cups or packers from the remainder of a cased well bore when the tubing string 32 is inserted into the well bore. At least one bore 46 enables fluid communication between an interior of the production tubing string 32 and the isolated fluid zone 44. The bore 36 may be replaced by a sleeve valve or the like. A bottom end of the zone isolating tool 40 includes a profile nipple (not illustrated) which supports a plug 48 or a control valve (not illustrated).

Figure 3:
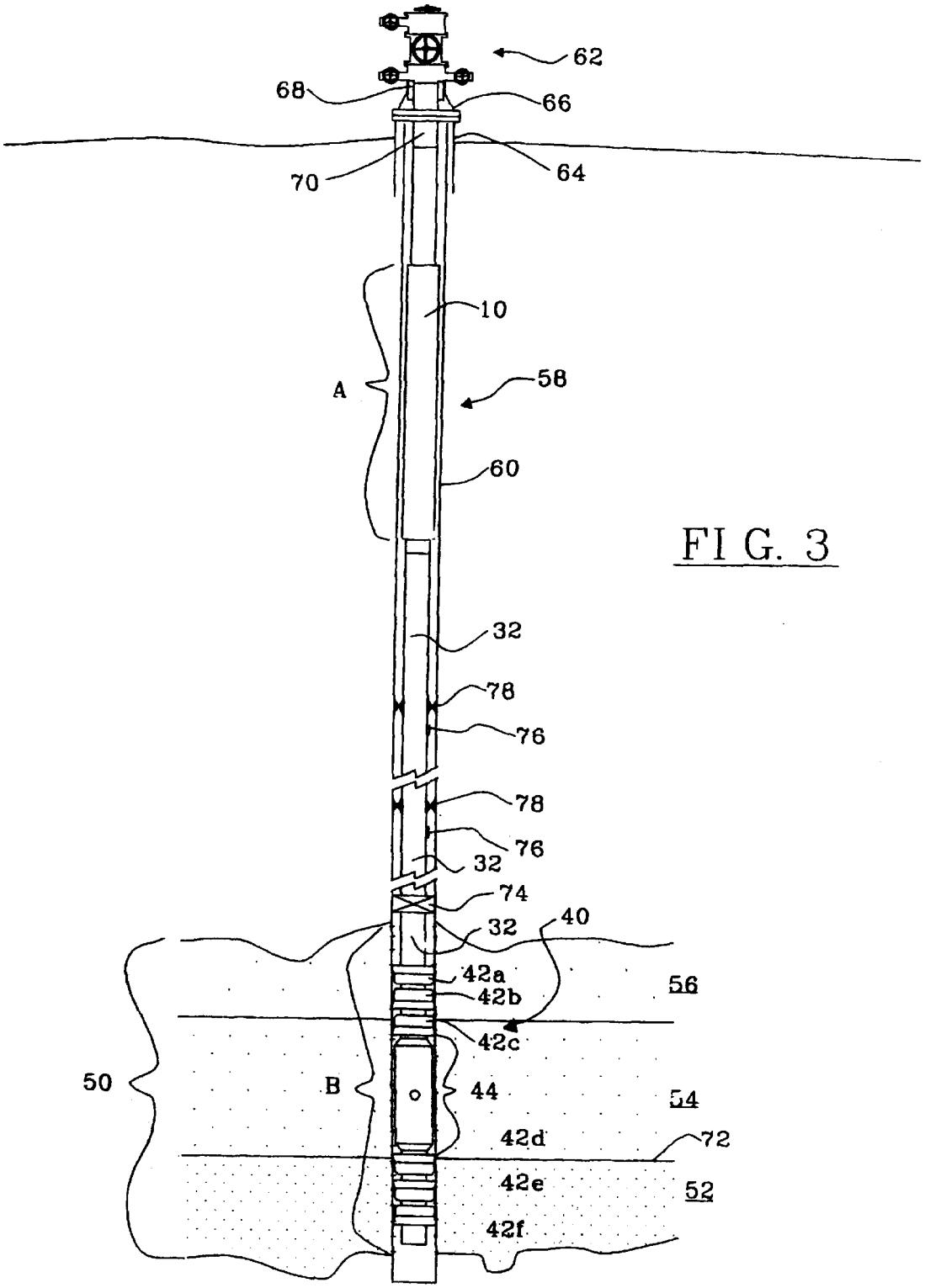
FIG. 3 is a schematic cross-sectional view of a well bore which passes through a production zone that produces fluids of different densities, the well bore being equipped with apparatus in accordance with the invention for selectively producing a fluid of interest from the production zone.

FIG. 3 shows the apparatus of FIG. 2 installed in a cased well bore which passes through a production zone 50 that produces water 52 oil 54 and natural gas 56. The well consists of a bore generally indicated by reference 58 lined with a casing 60 in a manner well known in the art. A wellhead generally indicated by reference 62 is mounted to a surface casing spool 64. A tubing spool 66 supports a tubing hanger 68 also in a manner well known in the art.

The telescoping joint 10 may be attached directly to the tubing hanger 68 or may be attached to the tubing hanger 68 by a "pup" joint 70 of production tubing. Alternatively, either the telescoping joint 10 or the pup joint 70 may be connected directly to the wellhead 62 in a manner well known in the art. The zone isolating tool 40 in accordance with the invention is preferably positioned in the production zone 50 so that at least the isolated fluid zone 44 is in the zone of interest, namely the oil "sandwich" 54. The downward facing cups 42*b* and 42*c* and the upward facing cups 42*d* and 42*e* isolate pressure from the oil sandwich 54 to prevent oil from being forced upwardly or downwardly out of the isolated fluid zone 44 so that oil in the casing is contained within the isolated fluid zone. The upward facing cup 42*a* prevents gas from being forced down through the casing 60 to enter the production tubing 32. While some gas may enter perforations that happen to be located between cups 42*a* and 42*c* and that gas may force past cup 42*e* into the isolated fluid zone 44, the amount of gas entering the isolated fluid zone 44 will be minimal. Likewise, while downward facing cup 42*f* will prevent most water from the water zone 52 from entering the isolated fluid zone 44, some water may seep through perforations located between cups 42*f* and 42*d*. A minimal amount of water may therefore be forced into the isolated fluid zone 44 but most water will be excluded by the downward facing cup 42*f* and predominantly only oil will be produced through the production tubing 32. As oil is produced from the oil sandwich 54, the water layer 52 typically rises. As the water layer rises, an interface 72 between the oil sandwich 54 and the water layer 52 also rises. This permits water to enter the isolated fluid zone 44 and be produced with the oil. As will be explained with reference to FIG. 4, the telescoping joint 10 is used to raise the production tubing 32 in order to adjust the position of the isolated fluid zone 44 in response to the change in position of the irterface 72. This repositioning is effected using the telescoping joint 10 in accordance with the invention.

In general, it is preferable that a length of travel "A" of telescoping joint 10 is substantially equal to the length "B" of a perforated zone of the casing 60 to permit downhole tools to be positioned anywhere within the perforated zone of interest. In a typical production installation such as shown in FIG. 3, a production packer 74 is located above the production zone 50 to isolate the zone from the pressure of gas injected into the annulus of the casing 60 to lift oil produced from the oil sandwich 54 to a surface of the well using gas-lift mandrels 76 positioned at intervals along the production tubing 32 in a manner well known in the art. Compression anchors 78 help support the compression load of the tubing string and prevent damage due to compression corkscrewing and the like. It will be readily understood by persons skilled in the art that the packer cups 42*a*–42*f* may be replaced by other fluid isolation apparatus such as straddle packers, or inflatable packers, as described above. In order to selectively produce a predominance of a fluid of interest it is only necessary that a fluid isolation zone 44 be created by sealing the annulus of casing 60 at or near each interface of the fluid of interest and that the zone isolating tool 40 be axially displaceable so that it is readily repositionable within the well bore to permit the zone isolating tool 40 to be relocated as required to produce a predominance of the fluid of interest.

It will also be understood by those skilled in the art that oil may be produced through production tubing equipped with apparatus in accordance with the invention using a pump such as a submersible pump, a progressive cavity pump or the like.

Figure 4:
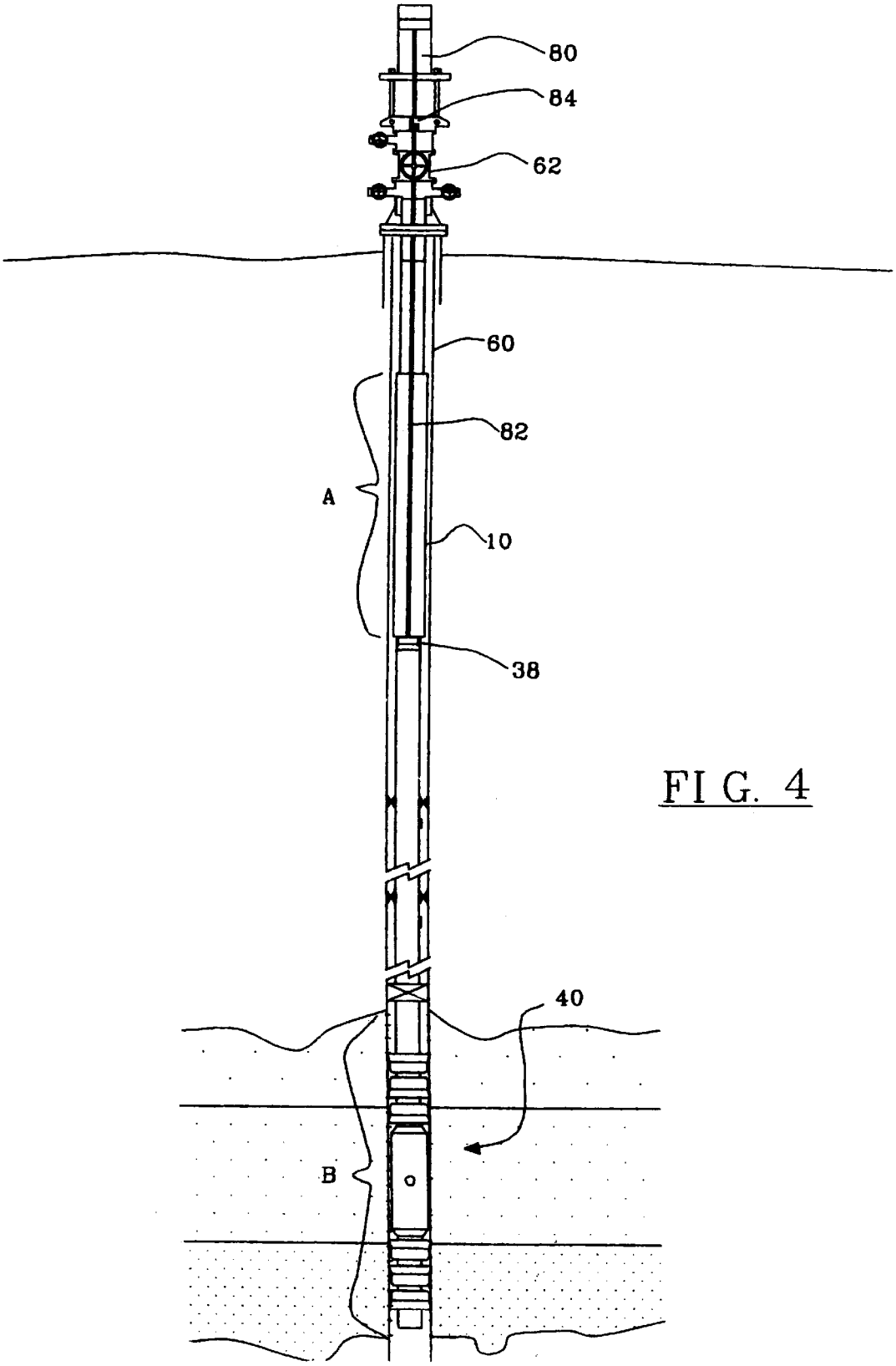
FIG. 4 is a schematic cross-sectional view of the well bore shown in FIG. 3 with apparatus installed on the wellhead for axially displacing the zone-isolating tool without removing the wellhead from the well.

FIG. 4 shows the apparatus of FIG. 3 with a mechanism temporarily installed on the wellhead 62 to permit the zone isolating tool 40 to be raised to produce oil from the oil sandwich 54. The apparatus shown in FIG. 4 is a hydraulic cylinder and a mount for the hydraulic cylinder taught in U.S. Pat. No. 4,867,243 which issued on Sep. 19, 1989 to Dallas. The hydraulic cylinder 80 is attached to a slick rod 82 which runs through a stuffing box 84 and down through the wellhead 62 and the telescoping joint 10 to the latch point 30 (see FIG. 1). The slick rod 80 connects to the latch point 30 to permit the tubing string 32 to be raised or lowered as required. In order to raise the production tubing 32, the slick rod 80 is rotated to release the compression anchors 78 and lowered then rotated again to release the production packer 74. The production tubing 32 is then raised to reposition the zone isolating tool 40 in the oil sandwich 54 as shown in FIG. 3. In order to facilitate this process, the slick rod 82 is preferably jointed in lengths approximately equal to the stroke of the hydraulic cylinder 80. Thus, fluid may be produced from a zone of interest by quickly and efficiently repositioning the zone isolating tool 40 using the hydraulic cylinder 80. This eliminates the requirement for a crane or derrick and the complicated and expensive process of killing the well and pulling the production tubing described above. It will be understood, however, that a crane or a derrick or any other appropriate lifting device may be used to reposition downhole tools attached below the telescoping joint 10 in accordance with the invention. It also optimizes production from the oil sandwich 54 by permitting frequent relocation of the isolated fluid zone 44 in response to travel of the oil sandwich 54 so that principally only oil is produced over a sustained interval and production is thereby proportionally increased over that interval. It will be understood that occasionally it may be necessary to pull the zone isolating tool for maintenance and/or to adjust the length of the isolated fluid zone 44 to ensure that predominately only the fluid of interest is produced.

Figure 5:
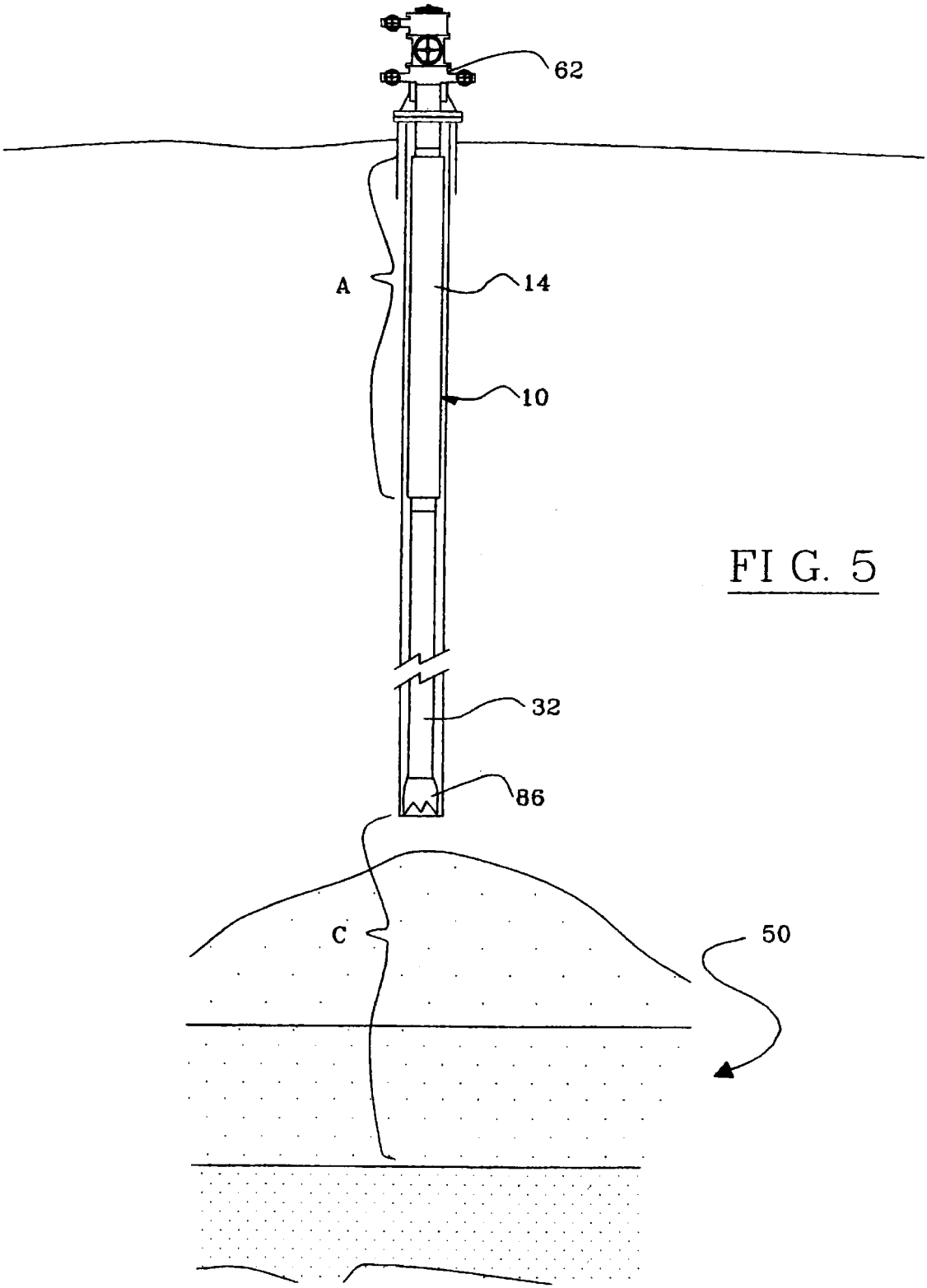
FIG. 5 is a schematic cross-sectional view of apparatus for a barefoot completion of a well bore using a telescoping joint in accordance with the invention.

FIG. 5 shows the telescoping joint in accordance with the invention being used in a barefoot completion of a well bore. Barefoot completions are typically used in carbonate formations where a significant discharge of drilling mud into the formation could damage the productivity of the formation, or in wells classified as critical which are located in formations known or believed to produce toxic and/or caustic gases such sour gases. The telescoping joint 10 in accordance with the invention may be used in any barefoot completion and has many advantages. To prepare for a barefoot completion using the telescoping joint 10, a tubing string 32 is assembled with a drill bit 86 which is driven by a hydraulic motor attached to its bottom end in a manner well known in the art. A top of the production tubing string 32 includes the telescoping joint 10. The length of stroke of the telescoping joint 10 is at least about equal to an interval "C" between a bottom of the cased well bore and a target depth for the finished well bore. The tubing string including the telescoping joint 10 is run into the well and connected to the tubing hanger 68 and the wellhead 62 is assembled. The hydraulic motor which drives the drill bit 86 is powered by fluid pumped down through the tubing string 32 in a manner well known in the art. The drill bit 86 is used to complete the drilling of the well bore from the bottom of the casing 60 to a target depth of the completed bore. The interval between a bottom of the cased well bore and a top of the formation is typically only a few meters so that significant quantities of drilling mud are not generated while drilling the interval and to further protect the formation it is preferable to use an underbalanced drilling technique. When well bore is completed to the target depth, the motor and drill bit 86 is typically detached from the production tubing string 32 and permitted to drop in a bottom of the bore where it may be later retrieved, if desired. Alternatively, the production tubing may be perforated or include a sliding sleeve of the like to permit the drill bit to remain attached. With the production string 32 already in place when drilling is completed, production from the production zone 50 may begin immediately. If necessary, a hydraulic cylinder such as shown in FIG. 4 may be connected to the telescoping joint 10 using the slick rod 82 to position the bottom end of the production tubing string 32 in a fluid layer of interest.

This method has advantages aside from the obvious advantage of increased speed to production and reduced expense of completion. For example, if the production zone 50 is designated a critical zone by regulation authorities, many of the requirements of completion are likely to be relaxed if a wellhead 62 is installed prior to the well being completed. Since the possibility of escape of toxic gas is substantially eliminated if a wellhead is in position, a much safer completion is ensured and fewer safety precautions are required.

Figure 6:
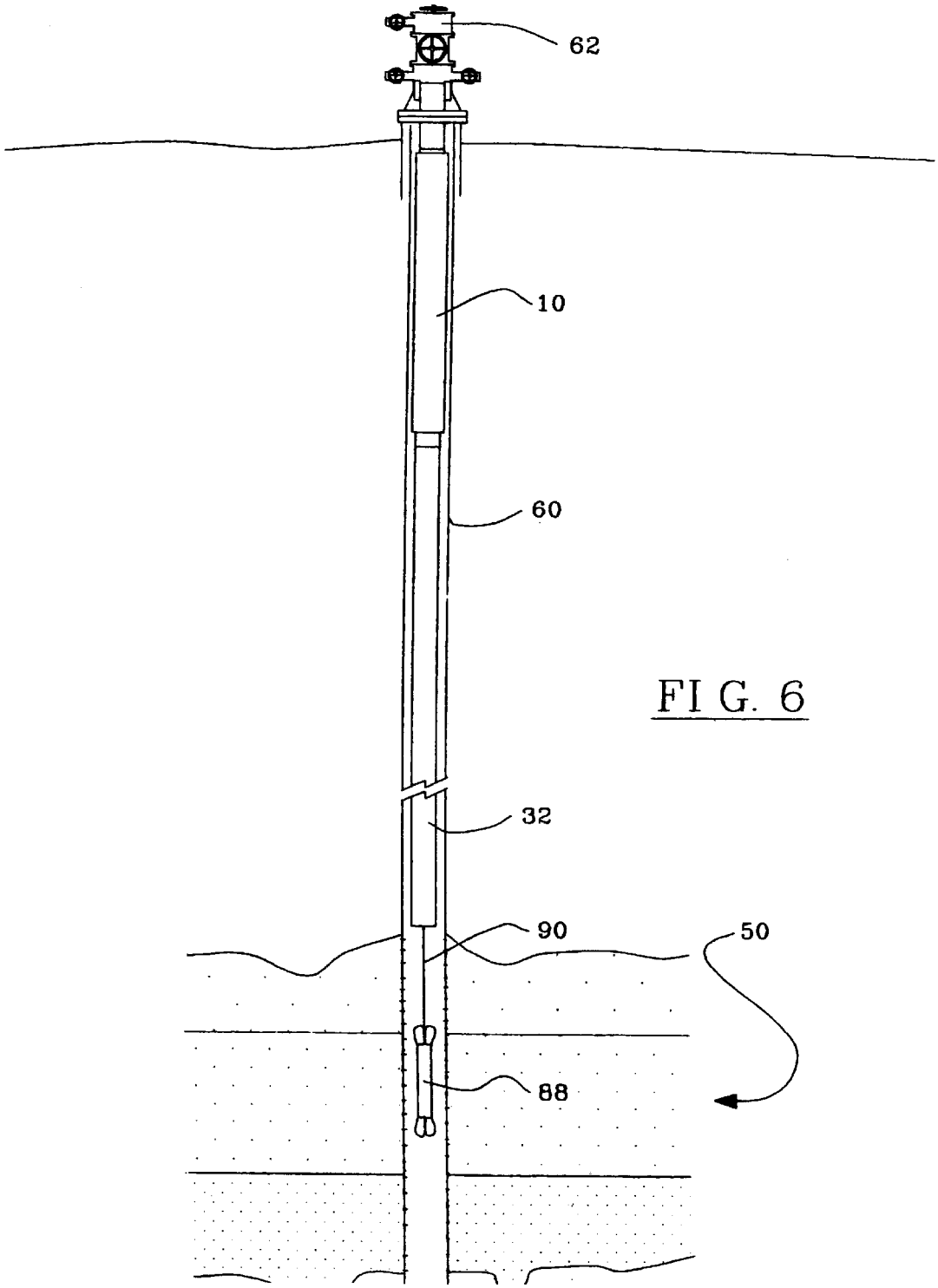
FIG. 6 shows a production zone logging operation in a well bore equipped with a production tubing which includes a telescoping joint in accordance with the invention.

FIG. 6 illustrates a further use of the telescoping joint 10 in accordance with the invention. In this figure, the production tubing 32 is shown in a raised condition so that it is positioned above the perforations of the production zone 50. occasionally, it is necessary or desirable to log a producing formation for any one of a number of reasons. It is advantageous to be able to log a production zone without removal of the production tubing 32 but logging through the production tubing 32 interferes with log results and may produce inaccurate readings. The telescoping joint 10 in accordance with the invention permits the production tubing string 32 to be retracted above the perforated zone so that a logging tool 88 may be lowered on a wireline 90 to log the production zone 50 in a manner well known in the art.

The apparatus in accordance with the invention also has many other uses. For example, the telescoping joint 10 may be used in conjunction with the zone isolating tool 40 to perform selective production testing of a production zone 50. By positioning the isolated fluid zone 44 (see FIG. 3) at a bottom of the perforations and sequentially performing a production test on each interval as the zone isolating tool 40 is raised by intervals equal in length to the isolated fluid zone 44, the production rate and production composition of each isolated portion of the production zone 50 can be ascertained to determine an optimal position for the isolated fluid zone 44 in order to maximize production from the production zone 50.

Likewise, the apparatus in accordance with the invention shown in FIG. 3 can be used to stimulate production using high-pressure fluids in a manner well known in the art. By stimulating isolated zones in the production zone 50 in a stepwise fashion as described above, a thorough stimulation of the entire production zone is ensured because high-pressure stimulation fluids are concentrated in each location of the isolated fluid zone 44. In common prior art practice, high-pressure stimulation fluids are generally infected simultaneously into an entire perforated zone of a casing. Since diffusion of the high-pressure stimulation fluids is neither localized nor controllable, it is difficult to predict whether the entire production zone is uniformly stimulated. Using the apparatus in accordance with the invention, however, uniform stimulation is ensured and repositioning of the isolated fluid zone 44 during the stimulation process may be accomplished using a simple apparatus such as the hydraulic cylinder 80 shown in FIG. 4.

Other applications for the apparatus described above will no doubt be apparent to those skilled in the art. Likewise, modifications to the preferred embodiments may occur to persons skilled in the art. For example, the telescoping joint 10 could be realized as a hydraulic cylinder in wells having larger diameter casings. The hydraulic cylinder could be equipped with hydraulic lines from the wellhead and be operated to reposition the downhole well tools without any lifting equipment on the surface. Likewise, the telescoping joint 10 could be realized as a mechanical screw. In that case, the outer tubular section could be provided with an internal thread and the inner tubular section could be rotatably connected to a hollow nut which engages the internal thread in the outer tubular section. To raise or lower the production tubing string, a latch point on the hollow nut could be engaged by a slick rod which could be rotated in an appropriate direction to extend or retract the telescoping joint.

Other modifications or variations may also become apparent to those skilled in the art. The scope of the invention is therefore intended to be limited solely by the scope of the appended claims.

I claim:

1. A telescoping joint for use in a conduit connected to a wellhead and supporting downhole well tools to permit the downhole well tools to be axially displaced in the well bore without disconnecting the conduit from the wellhead, comprising:

first and second telescopingly interconnected tubular sections having opposite ends adapted for connection to the conduit; and a latch point for connection of a member for extending or retracting the telescoping joint, the latch point being disposed internally of the telescoping joint so that the member can be inserted through the telescoping joint and connected to the latch point to controllably extend or retract the telescoping joint from one end of the conduit.

2. A telescoping joint for use in a conduit connected to a wellhead and supporting downhole well tools to permit the downhole well tools to be axially displaced in the well bore without disconnecting the conduit from the wellhead, comprising:

first and second tubular sections, the second tubular section having a larger diameter than the first tubular section;

the first tubular section having first and second ends and a polished outer surface which extends between the first and second ends, the first end being adapted for connection to a one of a wellhead or the conduit and the second end including stop means for preventing the first tubular section from being withdrawn from the second tubular section;

the second tubular section slidably receiving the first tubular section, the second tubular section having first and second ends, the first end including sealing means for providing a fluid seal with the polished outer surface of the first tubular section and the second end being adapted for connection to the other of the wellhead or the conduit; and means for connection of a member for extending or retracting the telescoping joint, the means for connection being disposed internally of the first section if the second section is adjacent the wellhead, and internally of the second end of the second section if the first section is adjacent the wellhead.

3. The telescoping joint for use in a conduit supporting downhole well tools as claimed in claim 2 wherein the telescoping joint further includes means for transmitting rotational torque from the first section to the second section and from the second section to the first section of the telescoping joint.

4. The telescoping joint for use in a conduit supporting downhole well tools as claimed in claim 3 wherein the means for transmitting rotational torque comprises:

at least one radially projecting key which extends axially from the stop means of the first tubular section; and at least one complementary keyway in an inner surface of the second section, the at least one complementary keyway slidably receiving the at least one radially projecting key.

5. The telescoping joint for use in a conduit supporting downhole well tools as claimed in claim 2 wherein the means for connection of a member for extending or retracting the telescoping joint comprises a latch point for the connection of a slick rod that is extended through the wellhead.

6. The telescoping joint for use in a conduit supporting downhole well tools as claimed in claim 5 wherein the slick rod is attached to a hydraulic cylinder affixed to a top of the wellhead and the telescoping joint is extended or retracted by forced reciprocation of the hydraulic cylinder.

7. Apparatus for providing an axially displaceable isolated fluid zone in a cased well bore and enabling fluid communication therewith, comprising in combination:

a tubing string having a top end and a bottom end;

at least one pair of sealing means for engaging an inner periphery of the casing of the cased well bore in a fluid tight seal, the sealing means being attached to the tubing string in a spaced-apart relationship for providing at least one isolated fluid zone when the tubing string is inserted in the cased well bore and the sealing means are in sealing engagement with the casing;

means for enabling fluid communication between the at least one isolated fluid zone in the well bore and an interior of the tubing string;

a telescoping joint for permitting axial displacement of a bottom section of the tubing string with respect to a top section thereof, the telescoping joint being located above the at least one pair of sealing means; and means for permitting the bottom section of the tubing string to be displaced with respect to the top section, whereby when the tubing string is inserted in a well bore and the top section of the tubing string is attached to a tubing hanger or the wellhead, the bottom section of the tubing string may be axially displaced to reposition the isolated fluid zone in the cased well bore.

8. Apparatus for creating an axially displaceable isolated fluid zone in a cased well bore and enabling fluid communication therewith as claimed in claim 7 wherein the means for enabling fluid communication between the at least one isolated fluid zone in the well bore and an interior of the tubing string comprises at least one bore which pierces a sidewall of the tubing string.

9. Apparatus for creating an axially displaceable isolated fluid zone in a cased well bore and enabling fluid communication therewith as claimed in claim 7 wherein the means for permitting the bottom section of the tubing string to be displaced with respect to the top section comprises a latch point in a top end of the bottom section of the tubing string where the bottom section is joined to the telescoping joint.

10. Apparatus for creating an axially displaceable isolated fluid zone in a cased well bore and enabling fluid communication therewith as claimed in claim 7 wherein the sealing means comprise cup type packers.

11. Apparatus for creating an axially displaceable isolated fluid zone in a cased well bore and enabling fluid communication therewith as claimed in claim 7 wherein the sealing means comprise straddle packers.

12. Apparatus for creating an axially displaceable isolated fluid zone in a cased well bore and enabling fluid communication therewith as claimed in claim 7 wherein the sealing means comprise inflatable packers.

13. Apparatus for creating an axially displaceable isolated fluid zone in a cased well bore and enabling fluid communication therewith as claimed in claim 7 wherein the tubing string further includes a selective production packer located above the sealing means.

14. Apparatus for creating an axially displaceable isolated fluid zone in a cased well bore and enabling fluid communication therewith as claimed in claim 8 wherein the tubing string further includes at least one compression anchor located above the selective production packer to support the compression weight of the drill string.

15. Apparatus for creating an axially displaceable isolated fluid zone in a cased well bore and enabling fluid communication therewith as claimed in claim 7 wherein the telescoping joint permits axial displacement of the bottom section of the tubing string over a distance that is at least equal to a perforated zone in the casing of the cased well bore.

16. Apparatus for creating an axially displaceable isolated fluid zone in a cased well bore and enabling fluid communication therewith as claimed in claim 7 wherein the telescoping joint includes means for transferring rotational movement of the top section of the tubing string to the bottom section of the tubing string.

17. Apparatus for creating an axially displaceable isolated fluid zone in a cased well bore and enabling fluid communication therewith as claimed in claim 16 wherein the means for transferring rotational movement of the top section of the tubing string to the bottom section of the tubing string comprises at least one radial key affixed to one section the telescoping joint and at least one radial keyway for receiving the at least one radial key formed in the other section of the telescoping joint.

18. Apparatus for creating an axially displaceable isolated fluid zone in a cased well bore and enabling fluid communication therewith as claimed in claim 7 wherein the tubing string further includes at least one gas lift mandrel located below the telescoping joint and above the sealing means.

19. Apparatus for creating an axially displaceable isolated fluid zone in a cased well bore and enabling fluid communication therewith as claimed in claim 7 wherein a bottom end of the tubing string includes a profile nipple.

20. Apparatus for creating an axially displaceable isolated fluid zone in a cased well bore and enabling fluid communication therewith as claimed in claim 19 wherein the profile nipple supports a plug for plugging the bottom end of the tubing string.

21. Apparatus for creating an axially displaceable isolated fluid zone in a cased well bore and enabling fluid communication therewith as claimed in claim 19 wherein the profile nipple supports a fluid valve for selectively closing the bottom end of the tubing string.

22. A method for producing a predominance of a fluid of interest from a cased well bore which passes through a production zone that yields at least two fluids having different densities, comprising:

a) locating a position of the production zone, a position of interfaces between the at least two fluids and a distance between top and bottom surfaces of the fluid of interest;

b) assembling a tubing string in the cased well bore, the tubing string including:

i) a pair of axially spaced-apart sealing means for providing an isolated fluid zone when the tubing string is inserted in the cased well bore, the sealing means being spaced-apart about as far as the distance between top and bottom surfaces of the fluid of interest, and the pair of sealing means being located on the tubing string so that they are respectively positioned near the top and bottom surfaces when the tubing string is attached to a wellhead of the cased well bore;

ii) means for providing fluid communication between the isolated fluid zone and an interior of the tubing string; and iii) a telescoping joint located above the pair of sealing means to permit axial displacement of a bottom section of the tubing string over a distance at least about as great as a perforated area of the casing of the cased well bore at the production zone;

c) attaching a top end of the tubing string to a tubing hanger at a top of the casing;

d) positioning the pair of spaced-apart sealing means so that they are respectively positioned approximate the top and bottom surfaces of the fluid of interest by axially displacing the bottom section of the tubing string using the telescoping joint, if required;

e) producing the fluid of interest from the isolated fluid zone in the well bore through the tubing string; and e) periodically adjusting a position of the bottom section of the tubing string to maintain at least one of the sealing means at the interface between the at least two fluids so that predominantly only the fluid of interest communicates with the isolated fluid zone.

23. A method for performing a barefoot completion of a well bore, comprising:

a) inserting a tubing string in a cased well bore, the tubing string including a drill bit attached to a bottom end thereof and a telescoping joint in a top end thereof, the telescoping joint having a length of travel at least equal to an interval to be drilled to complete the well bore;

b) attaching the tubing string to a wellhead of the well bore; and e) operating the drill bit until the interval is drilled, whereby the telescoping joint extends under gravity as the drill bit descends in the well bore.

24. The method of performing a barefoot completion of a well bore as claimed in claim 23 wherein the drill bit is driven by a motor or power swivel.

25. The method of performing a barefoot completion of a well bore as claimed in claim 24 wherein the drilling motor is driven by pumping fluid through the tubing string or by rotating the tubing string with a swivel.

* * * * *